US006601348B2

(12) United States Patent
Banks et al.

(10) Patent No.: US 6,601,348 B2
(45) Date of Patent: Aug. 5, 2003

(54) STRUCTURES FOR MITIGATING WIND SUCTION ATOP A FLAT OR SLIGHTLY INCLINED ROOF

(75) Inventors: David Banks, Fort Collins, CO (US); Partha P. Sarkar, Ames, IA (US); Fuqiang Wu, Houston, TX (US)

(73) Assignee: University of Colorado Research Foundation, Fort Collins, CO (US)

( * ) Notice: Subject to any disclaimer, the term of this patent is extended or adjusted under 35 U.S.C. 154(b) by 0 days.

(21) Appl. No.: 09/927,907

(22) Filed: Aug. 10, 2001

(65) Prior Publication Data

US 2002/0040555 A1 Apr. 11, 2002

Related U.S. Application Data

(60) Provisional application No. 60/224,564, filed on Aug. 10, 2000.

(51) Int. Cl.[7] ..... E04D 13/00; E04H 19/14

(52) U.S. Cl. ..... 52/25; 52/96; 52/84; 244/199

(58) Field of Search ..... 52/24–25, 84, 52/167.1, 96; 244/199, 214

(56) References Cited

U.S. PATENT DOCUMENTS

| | | | | | |
|---|---|---|---|---|---|
| 2,270,537 | A | * | 1/1942 | Ludington | 52/173.1 |
| 2,270,538 | A | * | 1/1942 | Ludington | 52/15 |
| 3,280,524 | A | * | 10/1966 | Hull | 52/173.1 |
| 3,828,498 | A | * | 8/1974 | Jones | 52/173.1 |
| 4,005,557 | A | | 2/1977 | Kramer et al. | 52/173 |
| 4,206,942 | A | * | 6/1980 | Nudo et al. | 296/180.5 |

(List continued on next page.)

FOREIGN PATENT DOCUMENTS

JP 2000-170273 * 6/2000

OTHER PUBLICATIONS

Banks, D., and Meroney R.N. (1999) "A model of roof–top surface pressure dependence upon local flow parameters," *Wind Engineering into the 21st Century*, 1097–1104—presented at the 10th International Conference on Wind Engineering held in Copenhagen Jun. 21–24, 1999.

Wu, E., Sarkar, P.P., and Mehta, K. C, (1999) "Understanding the conical vortex flow on roofs," *Wind Engineering into the 21th Century*, 1867–1874—presented at the 10th International Conference on Wind Engineering held in Copenhagen Jun. 21–24, 1999.

Richardson, G.M., and Surry, D. (1994), "The Silsoe Structures Building: Comparison between full–scale and wind–tunnel data", *J. Wind. Eng. Ind. Aerodyn.*, 51, 157–176.

(List continued on next page.)

*Primary Examiner*—Lanna Mai
*Assistant Examiner*—Winnie Yip
(74) *Attorney, Agent, or Firm*—Macheledt Bales LLP

(57) ABSTRACT

An apparatus secured to extend upwardly from a rooftop for redirecting free oncoming flow of a gas passing over an edge of the rooftop. The apparatus has an elongated member having at least a lower flow-surface, and a leading edge portion having a leading-rim extending therealong. A plurality of supports is spaced along the elongated member. An upper-end of each support is secured to, integrated-with, or otherwise extends from the lower flow-surface of the elongated member. There may be several such elongated members that may be joined. The lower-end of each support extends from the rooftop or sidewall structure to provide a spaced relationship between the lower flow-surface and the rooftop. The leading-rim of the leading edge portion extends into the oncoming flow to redirect of at least a portion thereof so that it flows under the leading edge portion and along the lower flow-surface and, preferably, on into a re-circulation region above the rooftop. A self-deployment mechanism for each support allow for deployment of the apparatus to an operational position upon sufficiently strong gusts.

16 Claims, 10 Drawing Sheets

U.S. PATENT DOCUMENTS

| | | | | | |
|---|---|---|---|---|---|
| 4,557,081 | A | * | 12/1985 | Kelly | 52/94 |
| 4,583,337 | A | | 4/1986 | Kramer et al. | 52/302 |
| 5,058,837 | A | * | 10/1991 | Wheeler | 244/199 |
| 5,740,636 | A | | 4/1998 | Archard | 52/94 |
| 5,918,423 | A | | 7/1999 | Ponder | 52/57 |
| 6,061,978 | A | * | 5/2000 | Dinwoodie et al. | 52/173.3 |

OTHER PUBLICATIONS

Lin, J.X., and Surry, D. (1993), "Suppressing Extreme Suction on Low Buildings by Modifying the Roof Corner Geometry", Proceedings of 7$^{th}$ US National Conferences on Wind Engineering, UCLA, Los Angeles, California, 413–422.

Surry, D. and Lin, J.X. (1995), "The Effect of surroundings and roof corner geometric modifications on roof pressures on low–rise buildings", *J. Wind Eng. Ind. Aerodyn*. 53, 113–138.

Cochran, Leighton S. and English, Elizabeth C. (1997), "Reduction of Roof Wind Loads by Architectural Features", *Architectural Science Review*, 40, 79–87.

* cited by examiner

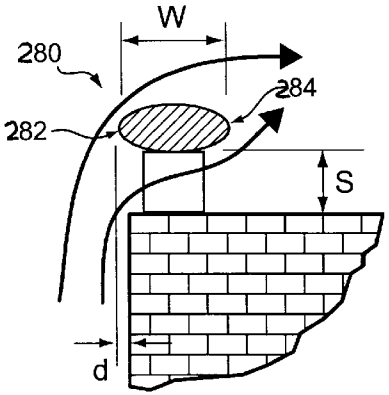
FIG. 7C
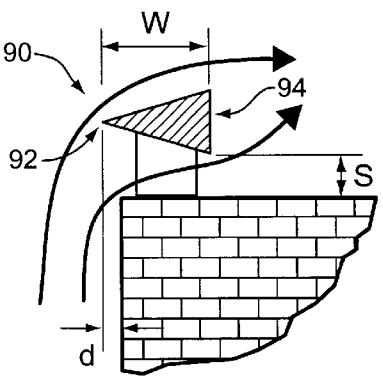
FIG. 7D
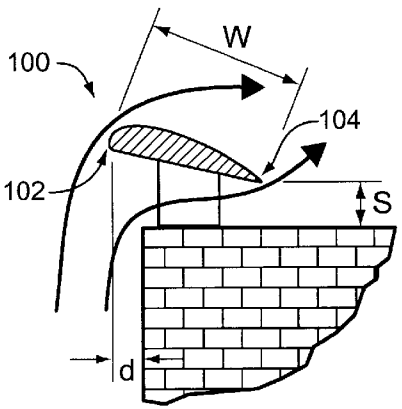
FIG. 7E
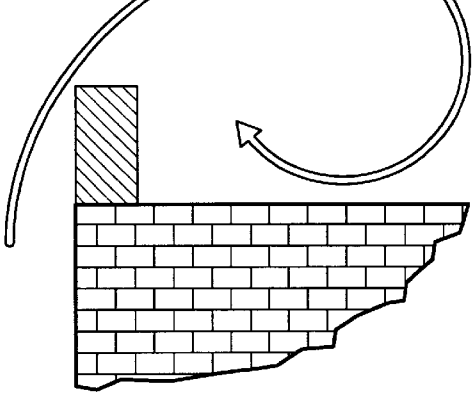
FIG. 8A
PRIOR ART
FIG. 8B
PRIOR ART
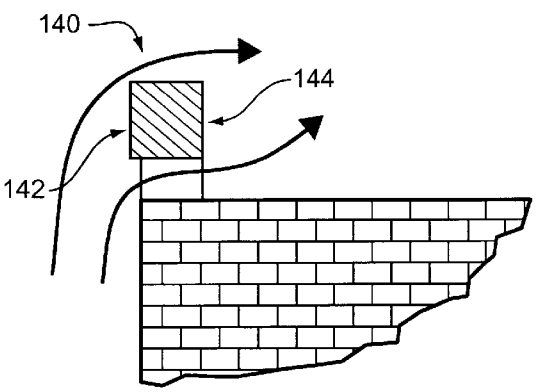
FIG. 7F

STRUCTURES FOR MITIGATING WIND SUCTION ATOP A FLAT OR SLIGHTLY INCLINED ROOF

This application claims priority under 35 U.S.C. 119(c) and 37 C.F.R. §1.78 to Provisional Patent Application US 60/224,564 filed Aug. 10, 2000.

The invention disclosed herein was made with United States government support awarded by the following agency: National Science Foundation co-operative program in wind engineering #CMS-9411147. Accordingly, the U.S. Government has certain rights in this invention.

BACKGROUND OF THE INVENTION

In general, the present invention relates to the prevention or reduction of wind suction forces induced on the roof of a flat top building, or only slightly inclined roof, generally less than a 40% grade, due to incident high winds. More particularly, the invention relates to unique rooftop structures and method for mitigating wind suction using an associated novel structural protuberance that extends at least partially into the shear layer/transition layer of the flow, whether permanently fixed to the roof top by suitable means, partially or fully embedding or otherwise integrating within the roof by molding, forming, setting, etc. These novel structures reduce or may eliminate the amplification of pressure drops caused by wind gusts flowing over the rooftop.

Windstorm related losses average several billion dollars annually. Roof covering failure, in particular, is a widespread type of damage observed after hurricanes. Once an area of the roof is damaged, building and home interiors are exposed to further damage from inclement weather. The focus of concern, here, is the damage caused to flat top or shallow pitched roofs of buildings due to high winds associated with a storm regardless of the particular meteorological designation of the storm. High winds cause unwanted roof suctions that can severely damage or completely destroy the roof as well as the building structure. More recent studies indicate that the worst mean and peak suctions on flat building roofs occur for 'cornering' or 'oblique' wind angles which are those wind components directed toward any corner of the building where roof-wall junction is 'sharp', i.e., incident winds directed over a range, in FIG. 1A labeled 14A, 14B with a representative angle, $\lambda_1$, from approx. 25° on either side of the central direction represented by arrow 12—for further reference see Attachment A, Banks, D. (spring 2000), as well as FIG. 4B illustrating incident cornering wind characteristics. As one can see, for cornering or oblique wind angles, conical-shaped vortices, also called delta wing vortices, form along the roof edges. For incident winds directed generally normal, or perpendicular, to a wall of the building with no significant cornering component, i.e., those incident winds directed over a range, in FIG. 2A labeled 34A, 34B with a representative angle, $\lambda_2$, from approx. 20° on either side of the direction represented by the central arrow 32—see also FIGS. 2B, 3A–3B, 4A, 5A–5B, and 6—the vortex induced suction is generally not as destructive as vortices formed during cornering winds. While previous studies have attempted to progress toward linking wind flow characteristics to surface pressures, prior to the instant analysis, the mechanism linking vortex structure and roof surface pressure has been little understood. The rigorous analysis performed and resulting dynamic link between vortex behavior, surface pressures, and wind flow characteristics as identified herein, have led to the ingenious structures of the invention.

Based upon the work of the applicants, comparison of simultaneously recorded image data of a rooftop corner vortex and pressures therebeneath indicate and confirm that the peak suction lies beneath the vortex core, and moves with the vortex. An explanation of the analysis and experimentation performed by applicants is found in Attachment A, Banks, D. (spring 2000), and Attachment B, Wu, F., excerpts from dissertation, Chapter 8—both of which are also identified below and are incorporated herein by reference.

The greatest force on the building is known to be the uplift on the roof, and this is a very common failure mode. The worst suction on both gabled and flat roofs are known to occur beneath the vortices that form in the separated flow along the roof edges. For the flow considered generally normal to a wall, FIG. 2A within the range defined by $\lambda_2$, a condition known as "bubble separation" predominates within which the vortices are formed, see also FIGS. 1C, 3A–4A, and more-particularly, FIG. 2.12 on page 67 of Attachment A. In this situation, the position of the reattachment varies considerably, and is considered unstable, and the vortices which form along the roof edge in the separated flow form and are convected away from the edge at irregular intervals. For reference, see FIG. 1C where reattachment at the rooftop 10 occurs at 29. In contrast, for cornering flow, the flow separation on flat or gabled roofs takes the form of stable dual conical vortices. Thus, it remains to more closely examine the flow mechanism by which a vortex instantaneously controls rooftop suctions. By focusing on understanding the vortex behavior as it is connected to rooftop suctions, the unusual corresponding pressure characteristics may be more fully examined. To do this, a novel analytical model for vortex pressure field was developed and assessed experimentally. This new model quantifies how two parameters, streamline curvature and flow speed above the vortex, control surface pressure. Experimental data confirms that the model accounts for changes in surface pressure with wind direction and proximity to the roof corner. Finally, the model suggests that by inhibiting the flow reattachment, the effect of the vortices on the roof can be by and large, eliminated.

Turning to the two-dimensional schematic 'snap-shots' of FIGS. 1C and 3A–3B, one can better appreciate the dynamics vortex flow model of the invention: Within the "transition region/layer" (TR) the velocity of the fluid (for example, air) is higher than that of the fluid on the same streamline, upstream, due to the well known fluid mechanics concept of the "continuity equation". The continuity equation embodies the concept of conservation of mass, and as applied to the situation here, one can appreciate that air. behaving essentially as an incompressible fluid, speeds up as it passes over the roof-edge of a building. Boundary layer theory dictates that the flow speed right at the roof surface must be zero so that the flow speed in the transition region decreases rapidly toward the roof. This results in shear stress and vorticity within the fluid flow so that one can make the correlation that the transition region/layer roughly corresponds to a 'shear layer'.

In the normal wind condition, the region of slow or re-circulating flow under the transition or shear layer is called the separation region, or, separation bubble. "Reattachment" of the flow is defined to occur at the 'end' of the separation region and is the point/area at which the flow returns to traveling generally parallel to the roof surface, once again, easier seen in FIG. 1C at 29. As one can see, in the normal incident wind case, the separation region encompasses the vortices as well as an area surrounding the vortices. Ideally, the preferred structures of an apparatus of the invention are positioned and affixed to disrupt, or, 'catch'/separate, the flow within the on coming flow's transition region (TR) such that this point of reattachment (e.g., 29) is moved further out and away from the roof-wall edge, toward the right in FIG. 1C.

In wind engineering research, interest in understanding roof corner vortices is high not only because of the direct correlation to high roof suction, but because of several peculiarities observed during pressure measurement:

1) The discrepancy between full-scale and model-scale peak pressures—while the results of scaled model studies and full-scale test provide matching mean pressure coefficients over the whole building, the peak and root mean square (rms) pressure coefficients do not match under the separated flow, where the vortices are located. There, the full-scale rms and peak suctions are higher for the full-scale tests. This is a concern, since the building codes of many countries are based upon scaled-model tests in boundary layer wind tunnels.
2) The quasi-stead theory is often used in building codes to predict peak pressures based upon knowledge of mean pressure coefficients and of the turbulence characteristics of the upstream flow. The quasi-steady theory is generally fairly accurate for most of the building, but does not work well for pressures beneath the separated flow.
3) Taps beneath the vortices have exhibited bi-modal probability distributions. This is not generally seen anywhere else on the structure.
4) Extreme peak pressures beneath the vortices are better correlated along the length of the vortex than velocity gusts in the upstream flow, or pressures elsewhere on the building—the result of the presence of a coherent flow structure on the building roof (the vortex).

Prior attempts by other researchers to understand how upstream flow conditions could control rooftop surface pressures reveals that the debate over the discrepancies identified immediately above, is really subordinate to the question of explaining how the extremely low pressures near the roof edge occur. Until applicants' rigorous analysis and identification or their solution, no acceptable explanation had been offered for the existence and occurrence of these extremely low pressures.

While it is known that replacing a sharp building edge with a curved roof-wall edge plays a part in disrupting the creation of unwanted rooftop vortices due to incident winds, see FIG. 1 on page 160 of Richardson and Surry, as does securing a tall enough solid parapet flush with the building outside wall, see for reference, FIG. 8B, around the full periphery of the roof, these are impractical and undesired architectural solutions due to additional cost as well as design and aesthetic considerations, and to the problem of building and roof damage and destruction due to high winds. Other than these designs, prior solutions suggested to minimize roof damage include: super-reinforced joints/edges, and a membrane overlying a deck with an air permeable and resilient mat installed over the membrane.

Therefore, new useful structures and methods are needed for mitigating the uplift effect caused by vortices created due to incident high winds atop flat or slightly inclined roof surfaces. Unlike conventional systems and solutions, the innovative apparatus and associated technique for mitigating, and under certain circumstances, eliminating the vortices in the separated/re-circulation flow zone/region, is a more-effective, less costly tool for doing so. In the spirit of design goals and related system analysis contemplated hereby, many different types of materials, securing and mounting mechanisms, self-deployment assemblies, and associated structures apply, as will be further appreciated.

SUMMARY OF THE INVENTION

It is a primary object of this invention to provide a rooftop apparatus for mitigating wind suction forces induced on a generally flat top, or slightly inclined, generally less than a 40% grade, rooftop due to incident high winds, whether cornering or normal. The focus is to provide unique rooftop apparatus structures and a corresponding technique comprising novel structural protuberances that extend at least partially into the shear layer/transition layer as identified here, to separate the flow therein. The structures need not be large, and need not extend the whole of the periphery of the roof edge. But rather, the novel smaller-sized sturdy structures of the invention are positioned and suitably anchored/affixed/mounted/integrated with a rooftop, wall, frame, the ground, etc. in proximity to one or more of the corners of the building or any other area of interest to reduce amplification of rooftop pressure drops, thus, reducing the high peak suctions experienced beneath separated flows atop the roof.

The advantages of providing the new apparatus and technique of the invention include: simplicity of design and installation; case of adaptation to the wide variety of flat and slightly inclined rooftop and building designs—providing additional design tools to architects and structural engineers in creating new plans, remodeling existing structures, and accommodating design flaws in either; plus a reduction in overall cost to fabricate and employ as partial or full solutions to rooftop and related building damage due to incident high-winds. Further, these and other advantages plus a better understanding of the very distinguishing features of the instant invention, as described and supported by this disclosure, will be readily appreciated in connection with reviewing the attachment excerpts and drawings, as well as the specification and claims.

Briefly described, once again, the invention includes an apparatus secured to extend upwardly from a rooftop for redirecting free oncoming flow of a gas passing over an edge of the rooftop. The apparatus has an elongated member having upper and lower flow-surfaces, and a leading edge portion having a leading-rim extending therealong. A plurality of supports is spaced along the elongated member. An upper-end of each support is secured to, integrated-with, etc., or otherwise extends from the lower flow-surface of the elongated member. The lower-ends of each support can be mounted, integrated-with/built into, or otherwise suitably fastened or secured directly to the rooftop, integrated-with/mounted to a substantially rigid elongated horizontal structure which is, in turn, mounted to the rooftop, and so on, so as to extend therefrom providing a spaced relationship between the lower flow-surface and rooftop. The leading-rim of the leading edge portion extends into the oncoming flow to redirect of at least a portion thereof so that it flows under the leading edge portion and along the lower flow-surface.

In the case of heavy winds, especially those experienced with severe weather including tornado and twisters of the Midwest, hurricanes of the Coastal regions, and associated heavy prevailing winds, the free oncoming flow of a gas includes a strong gust of wind, which can be brief or extended/prevailing heavy winds, with a transition flow region. Over the rooftop the transition region of the oncoming flow, labeled "TR" for reference in FIGS. 3A and 3B, is generally bounded, below, by a re-circulation region wherein flow of the wind travels in a circuitous motion. This unstable re-circulation region can include a vortex such as those depicted with swirling arrows throughout the drawings—necessarily in depicting such wind phenomena in still-life schematic views, an instant in time is captured and drawn although in the case of wind gusts, vortices existing within the re-circulation region are quite unstable. Preferably, the elongated member of the invention is mounted/secured/integrated such that its leading-rim extends into at least this transition flow region of the oncoming flow; in most instances, the leading-rim will protrude out over the edge of the rooftop. Critically, in effect, the leading edge portion of the elongated member 'catches' at least a portion of the oncoming flow so that it can be redirected under and along the lower flow-surface toward and into the re-circulation region; by doing so, the creation of vortices can be prevented, thus, mitigating the strong suction associated with vortices, atop the roof. Rooftop edge, as contemplated and used throughout, is inclusive of the edges of the roof (often referred to as 'leading edges' in the literature in connection with an oncoming wind gust direction) as well as roof corners—the total number of which will depend upon number of walls joining at angles.

The cross-section of the elongated member, taken between the leading edge portion and trailing end portion of the elongated member, can be of a number of identifiable shapes such as: an oval, a thin-irregular oval, an airfoil, a triangle, a rectangle, a thin-irregular rectangle, a circle, a thin-plate having a curvilinear leading edge portion, a thin-irregular wave-shape, a polygon, and a thin-irregular polygon, for reference by way of example only, see FIGS. 3A, 5B, 7A–7F, 9, 10, 12A–12D. Thus, as shown, the upper and lower flow-surfaces may each be generally planar, may include one or more curvilinear surface (convex or concave), may include an angle, and so on. Likewise, as shown, the leading edge portion of the elongated member can include an angled surface, e.g., FIG. 3A, one or more curvilinear surface, e.g., FIG. 5B, a flat surface, e.g., FIG. 7B, and so on. Furthermore, the lower flow-surface can be oriented in a decline, e.g., see FIGS. 1C, 7B, 7E, 9, 12B, 12D—wherein the leading edge portion of the elongated member is located further from the rooftop than that of a trailing end portion thereof.

For reference, a distance, d, that the leading-rim protrudes from a sidewall of a building to which the rooftop is attached, may be between 0.05% and 75% of the width, w, of the elongated member as measured from its leading-rim to its trailing end; and in terms of spacing, s, distance, d, as shown is less than a vertical distance, s, between the rooftop and a closest point of the lower flow-surface to the rooftop. A second elongated member can be joined at an end of the first elongated member in angled positional relationship, such as is shown in FIG. 6 at 60A and 60B and in FIGS. 11A–11C at 20A and 20B, for reference only, in a V-shape. Where the edge of the rooftop includes a corner interposed between a first and second edge-length of the roof (likewise angled), at least two of the supports are preferably mounted to the rooftop along each of the first and second edge-lengths, for stability. Further, as identified at 220 in FIGS. 11A–11B, one or more support can be reinforced by a metal strip fastened to a respective sidewall.

The supports may each include a self-deployment mechanism, for reference, see FIGS. 12A–12D: The elongated member has a first lowered position, which, for certain configurations, may mean at least a portion of its lower flow-surface is in contact with the rooftop, and includes moving parts such that it is adapted for moving into a second position. Here, while in its first lowered position, when a gust of wind sufficiently-strong blows against the elongated member, it is self-deployed to its second operational position. The self-deployment mechanism may comprise a first and second hinged extension. The support upper-end is pivotally secured to the lower flow-surface and the support lower-end is pivotally secured to extend from the rooftop. These hinged extensions when in the lowered position are in a generally folded arrangement and adapted for locking into place upon reaching the second position. Alternatively, the mechanism may comprise a plurality of telescoping sections located, while in the first lowered position, substantially below the rooftop's surface, and adapted for locking into place upon reaching the second position.

By way of example only to illustrate prior attempts to address rooftop damage: (a) a baffle stated to exert a displacing effect on wind flow across a roof surface is suggested in U.S. Pat. No. 4,005,557 issued to Kramer, et al. on Feb. 1, 1977—in Col. 3 of Patent '557, the inventor states that "[t]he optimum value of the ratio of open surface to closed surface for preventing or reducing wind suction forces should not exceed 50%", and (b) a wind spoiler ridge row cap for shallow pitched gabled roofs is suggested in U.S. Pat. No. 5,918,423 issued to Ponder on Jul. 6, 1999.

BRIEF DESCRIPTION OF THE DRAWINGS

The accompanying drawings illustrate the innovative nature plus the flexibility of design and versatility of a preferred apparatus of the invention, and its alternatives. One will better appreciate the invention by reviewing these accompanying drawings, in which like numerals designate like parts, if included, plus the listed and attached technical excerpts of dissertation materials authored by one or more the applicants hereof, pertinent portions of which are hereby incorporated herein, by reference. These drawings and materials have been included to communicate features of the innovative apparatus of the invention by way of example, only, and are in no way intended to unduly limit the disclosure hereof.

FIGS. 7A–7F are sectional views of alternative structural configurations for an apparatus of the invention atop a side plan view of the building rooftop. In each case, a vertical support strut is illustrated—these operate to anchor the respective structure to a roof, wall, frame, or grounded support member. Although not illustrated, one can appreciate that the support may be anchored to any of these.

FIGS. 8A and 8B illustrate the direction of oncoming flow as it begins to form a re-circulation region over the rooftop in the case where there is no device, see FIG. 8A, and depicting what has been tried before—a simple rectangular solid parapet atop a roof, see FIG. 8B. Oncoming flow re-circulates to create vortices with strong, structural-damaging suction underneath; see also for reference FIGS. 1A–1B and 2B—2B.

FIG. 11C is a view looking toward the V-shape as taken from on top of rooftop 10.

FIGS. 12A and 12C illustrate a lowered position of the elongated member and FIGS. 12B and 12D illustrate the affect of a sufficiently-strong gust—in FIGS. 12A and 12C, oncoming flow is labeled 232—to create enough lift in the direction of arrows labeled, respectively, 175 and 185 to move the elongated member into position for operation.

[1] Attachment A—Banks, D. (spring 2000), excerpts from the dissertation confidentially-submitted by applicant David Banks for the degree of Doctor of Philosophy included herewith as technical background for its rigorous wind engineering-analysis/characterization in further support of the technology.

[2] Attachment B—Wu, F., an excerpt from the dissertation confidentially-submitted by Fuqiang Wu for the degree of Doctor of Philosophy (excerpts from Chapters 8) included herewith as technical background discussion, particularly its rigorous wind engineering-analysis/characterization in further support of the technology.

[3] List of Symbols—an appendix to supplement Attachment A and B analysis.

DETAILED DESCRIPTION OF THE PREFERRED EMBODIMENTS AND ALTERNATIVES

Figure 1A:
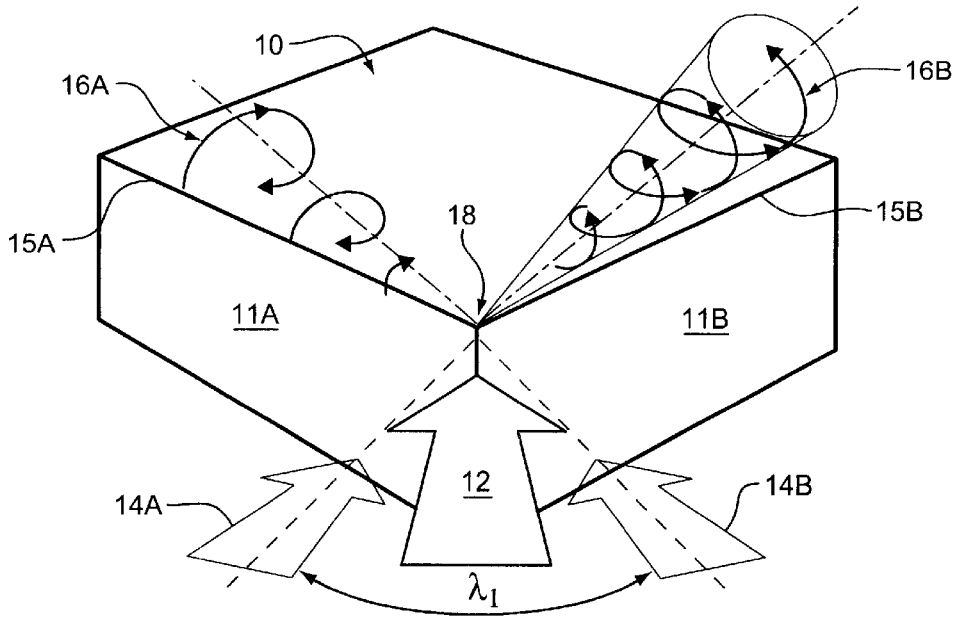
FIG. 1A is an isometric depiction of the vortices that form atop a building structure having a rooftop 10, due to a cornering wind.
Figure 1B:
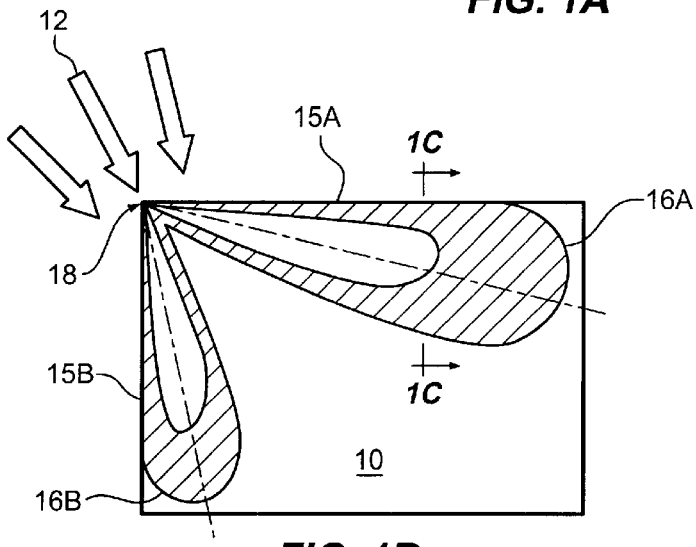
FIG. 1B illustrates further detail of cornering wind vortices in the form of, a top plan view of rooftop 10. Here, ref. 16A and 16B point to regions of high suction, which include regions of extremely-high suction (no section lines), under vortices 16A, 16B.

FIGS. 1A–1B, 2A–2B, 4A–4B are isometric depictions, with the exception of the top plan view in FIG. 1B which further depicts regions of extreme suction atop the roof due to vortex formation in the re-circulation region, of the vortices that form due to a cornering winds (see FIGS. 1A and 4B) and normal incident wind (see FIGS. 2A–2B and 4A) as uniquely identified and contemplated according to the analysis of the invention.

Figure 1C:
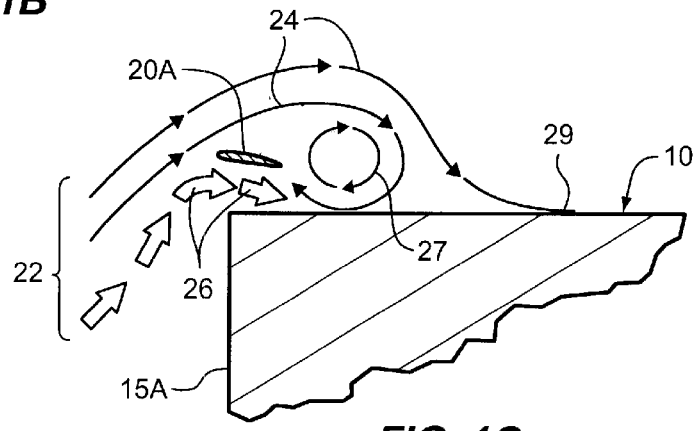
FIG. 1C is a sectional view taken along 1C—1C of FIG. 1B, illustrating oncoming free flow 22, separated here by the addition of an elongated member 20A of the invention, cross-section is shown, here—see also FIGS. 11A–11C isometric depictions.
Figure 2A:
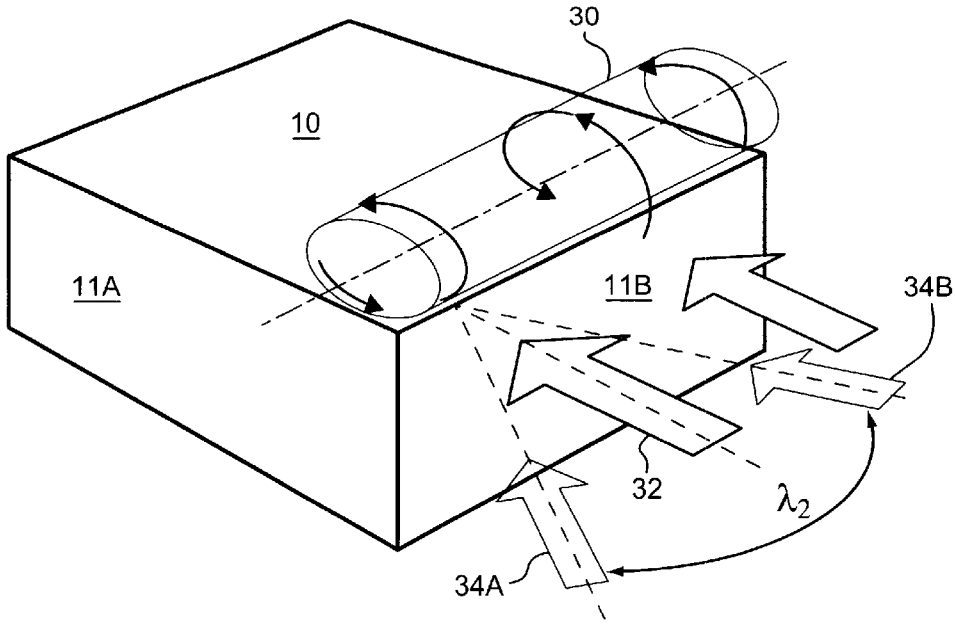
FIGS. 2A and 2B are isometric depictions of the vortices that forms atop the roof (FIG. 2A) and along sidewalls of a building (FIG. 2B) due to normal incident wind—the "separation bubble" is the area generally surrounding and including the vortex, defined at 30, 36A, 36B. Regions of high- and extremely-high-suction are beneath the vortices.
Figure 2B:
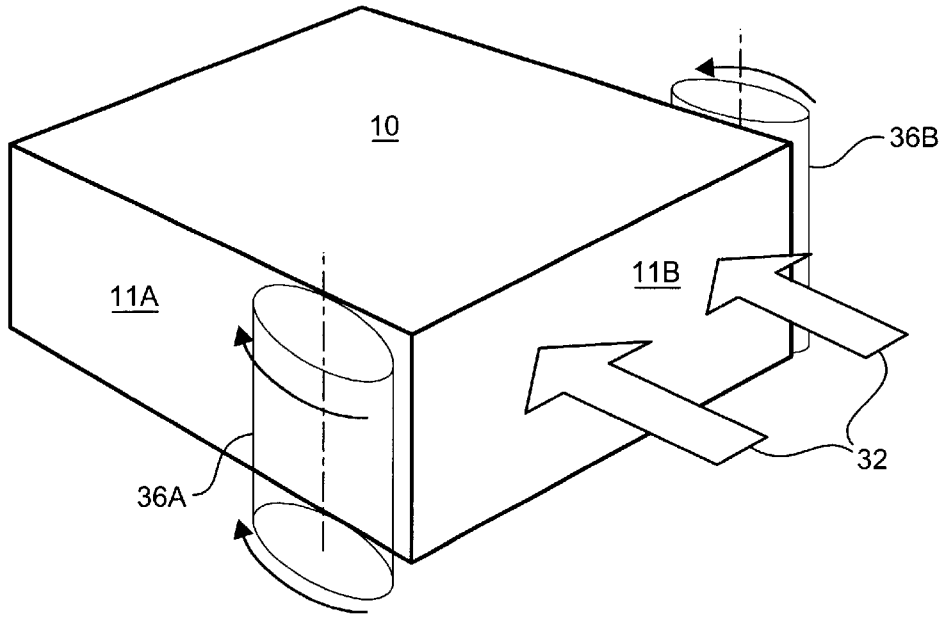

FIGS. 1A–1B depict the cornering incident wind directed at corner 18 interposed between incident-wind roof edges 15A, 15B along the direction labeled by arrows 12, i.e., incident winds directed over a range labeled 14A, 14B with a representative angle, $\lambda_1$, from approx. 25° on either side of the central direction represented by arrow 12. As mentioned above, for incident winds directed generally normal, or perpendicular, to a wall of the building with no significant cornering component—i.e., those incident winds directed toward wall 11B over a range, in FIG. 2A labeled 34A, 34B with a representative angle, $\lambda_2$, from approx. 20° on either side of the direction represented by central arrow 32—the vortex induced suction is generally not as destructive as vortices formed during cornering winds. In FIG. 2A, the re-circulated flow bounded for reference by 30 gets set up atop roof 10. In FIG. 2B re-circulated flow is set up at 36A along wall 11A, and at 36B along an opposite, albeit unlabeled, wall. Turning to the FIG. 1C sectional view taken along 1C—1C of FIG. 1B, oncoming free flow 22 is separated by the elongated member 20A having a leading edge portion that catches a portion of oncoming flow 22 to redirect (arrows 26) into and toward the vortex depicted at 27. See also FIGS. 11A–11C with generally full scale isometric depictions of a corner of a building and the edge of the rooftop 10 to which an apparatus made of two joining elongated members 20A, 20B has been mounted.

Figure 3A:
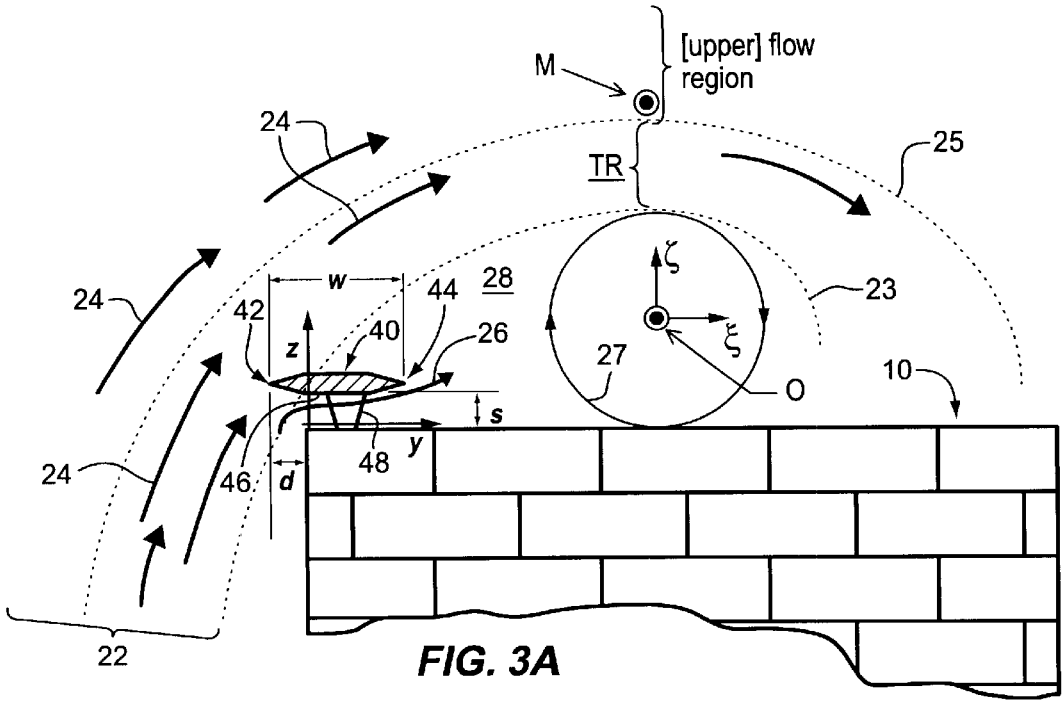
FIG. 3A is a two-dimensional depiction of the vortex flow model illustrating a snapshot of a vortex outlined at 27, and placement of an apparatus of the invention having a leading edge portion with a leading-rim extending into the oncoming flow's transition region (TR) such that, here, it protrudes out over the edge a horizontal distance labeled "d" for reference.
Figure 3B:
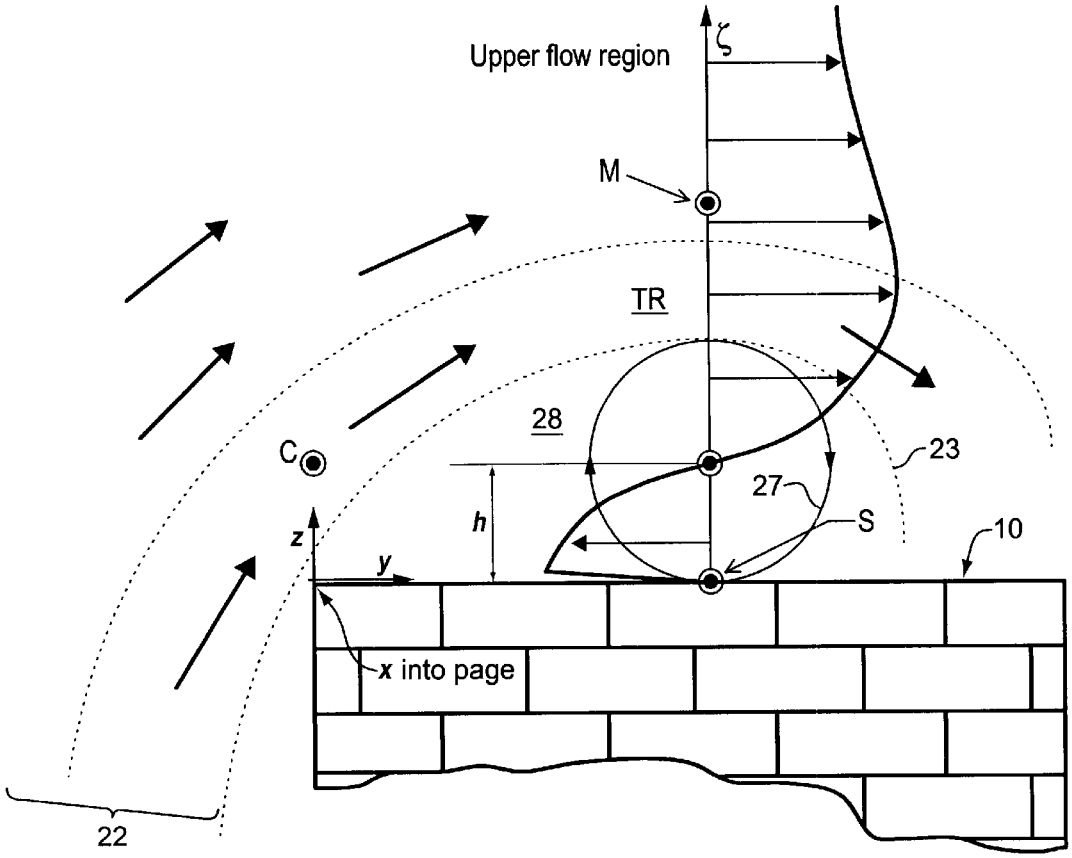
FIG. 3B is a two-dimensional depiction of the vortex low model illustrating a snapshot of a vortex outlined at 27, similar to that of FIG. 3A except no apparatus of the invention is shown for simplicity. The FIG. 3B graphical representation, along with FIG. 3A, provide further detail of terms used in the flow model equations according to the rigorous analysis performed by one or more of the applicants.

FIGS. 3A and 3B, for reference, provides a graphical representation, including a snapshot of a vortex outlined at 27, of the terms used in the flow model equations identified, earlier, by at least one of the applicants as discussed in earlier work: Banks, D., and Meroncy R. N. (June 1999) "A model of roof-top surface pressure dependence upon local flow parameters," *Wind Engineering into the* 21$^{st}$ *Century,* 1097–1104, and presented during proceedings of the 10$^{th}$ International Conference on Wind Engineering, in Copenhagen. The FIG. 3A two-dimensional depiction of the vortex flow further includes placement of the uniquely positioned apparatus of the invention having a leading edge portion 42, which by way of example as depicted includes a leading-rim comprising an angled surface, that extends into the oncoming flow's transition region (TR) such that, here, it protrudes out over the edge a horizontal distance labeled "d". For reference as suggested, distance, d, can preferably be between 0.05% and 75% of the width, w, of the elongated member as measured from its leading-rim 42 to its trailing end identified generally at 44 of member 40. And further, in terms of spacing, s: distance, d, as shown is less than a vertical distance, s, between the rooftop and a closest point of the lower flow-surface to the rooftop. For easy reference, by way of example only, d, w and s are labeled elsewhere throughout the figures.

Once again, at least a portion of oncoming flow 22 is caught by leading edge portion 42 to redirect flow along 26 and into 28, the re-circulation region including, here at this moment in time, a vortex depicted at 27 centering around point O. Arrows labeled 24 illustrate the generally streamlined nature of flow 22 as bounded by 23 within which re-circulation region 28 falls. The transition region (TR) for this instant is bounded between dashed lines 23 and 25 for reference. Leading edge portion 42 noticeably extends into TR where vertical support 48 is currently mounted; although elongated member 40 could be moved along the y-direction, and mounted, while maintaining at least its leading-rim within the TR. The two-dimensional depiction of the vortex low model in FIG. 3B provides further understanding of the terms used in the flow model equations according to the rigorous analysis performed by one or more of the applicants, as no apparatus is shown for simplicity; see, also Attachment A.

Figure 4A:
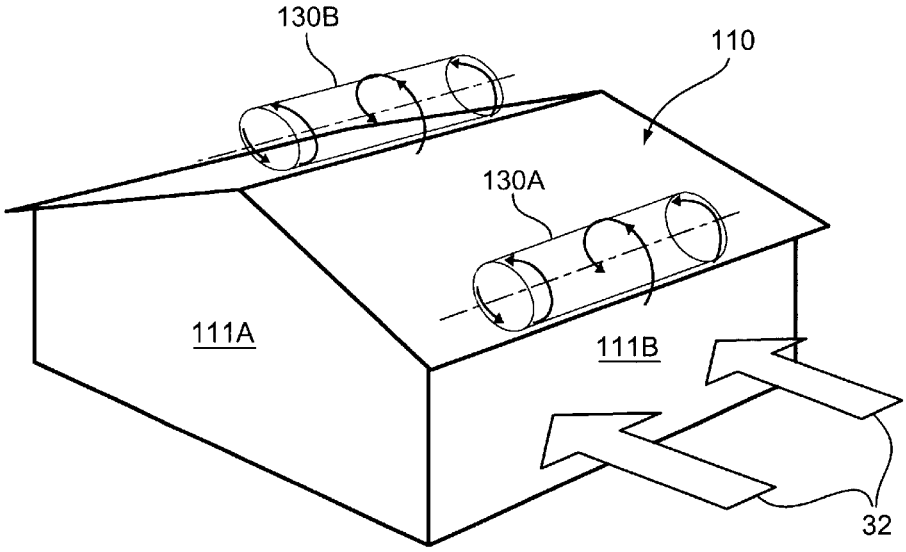
FIGS. 4A and 4B are isometric depictions of vortices that form atop the roof of a slightly pitched roof, generally less than a 40% grade, due to normal wind, traveling in the direction of arrows 32 in FIG. 4A, and cornering wind, traveling in the direction of arrows 112 in FIG. 4B.
Figure 4B:
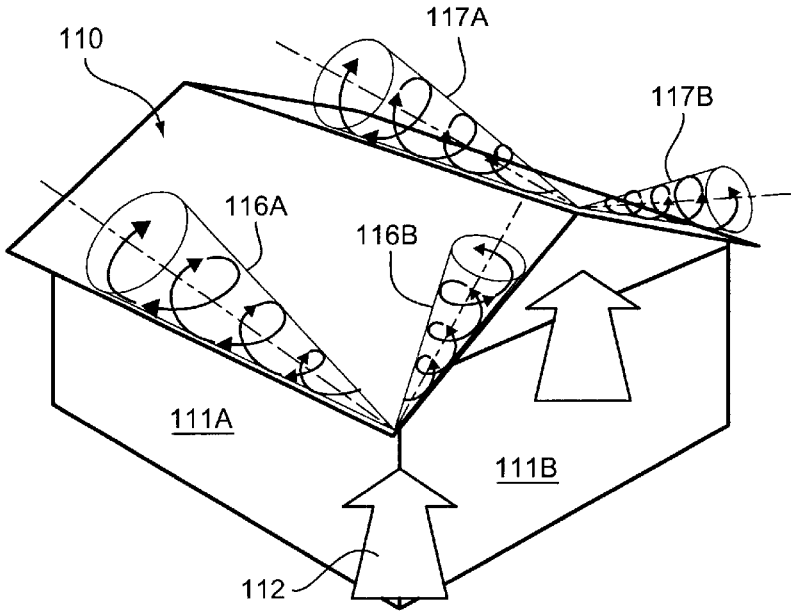

FIGS. 4A and 4B are isometric depictions of vortices labeled 130A, 130B, 116A, 116B, 117A, 117B that form atop the roof of a slightly pitched roof, generally less than a 40% grade, due to normal wind, traveling in the direction of arrows 32 in FIG. 4A, and cornering wind, traveling in the direction of arrows 112 as shown in FIG. 4B.

Figure 5A:
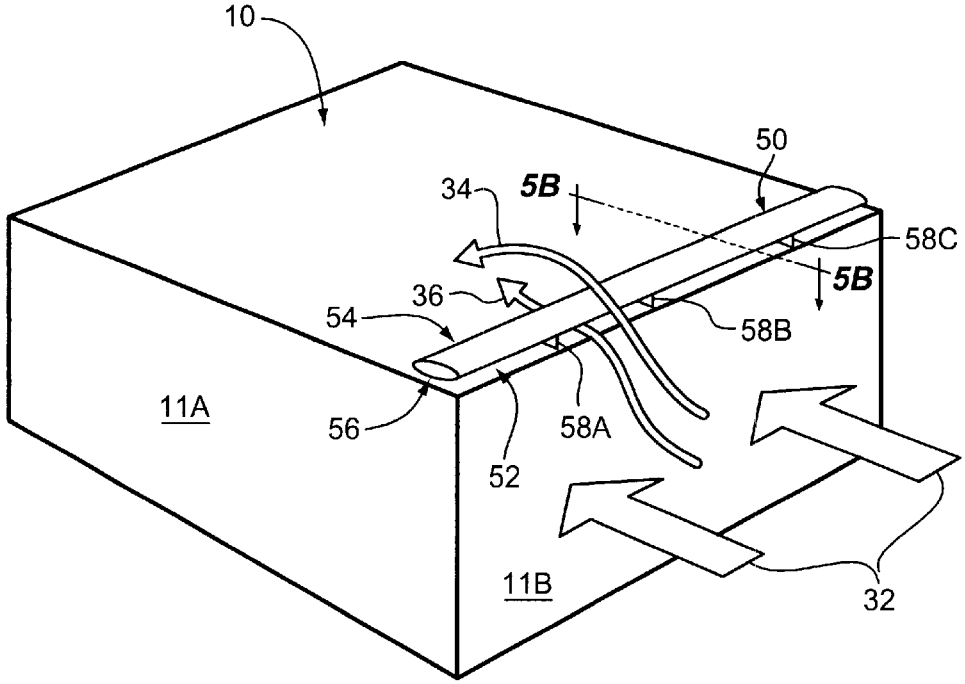
FIG. 5A is an isometric depiction of a structural configuration of an apparatus of the invention affixed to the rooftop 10 of a building, an elongated member extending along one edge of the roof.
Figure 5B:
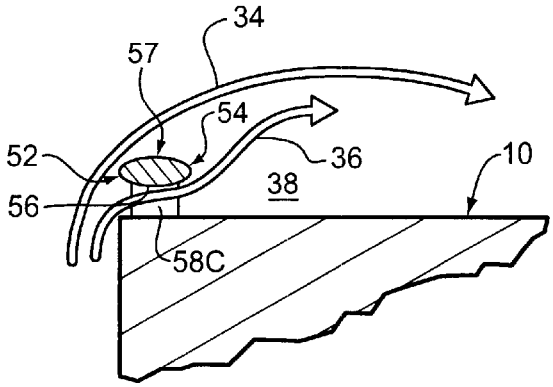
FIG. 5B is a sectional view taken along 5B—5B of FIG. 5A illustrating the flow of air/gas as it is disrupted and redirected, along the lower flow-surface labeled 56, see direction arrow 36, by the elongated structure member configuration depicted.

Referring collectively to FIGS. 5A and 5B, the elongated structure of the invention, generally at 50, is affixed to the rooftop 10 of a building with sidewalls labeled 11A and 11B. Supports 58A–58C are spaced apart atop roof 10 along its incident-wind edge which is not labeled, here, but for reference see FIG. 1A at 15B. Leading edge portion 52, here shown having a curvilinear surface, redirects oncoming flow along lower flow-surface 56 in a direction identified by directional arrow 36. That portion of oncoming flow not so redirected travels generally around upper flow-surface 57 in a direction identified by directional arrow 34. For reference in both FIGS. 5A and 5B, a trailing end of member 50 is labeled 54.

Figure 6:
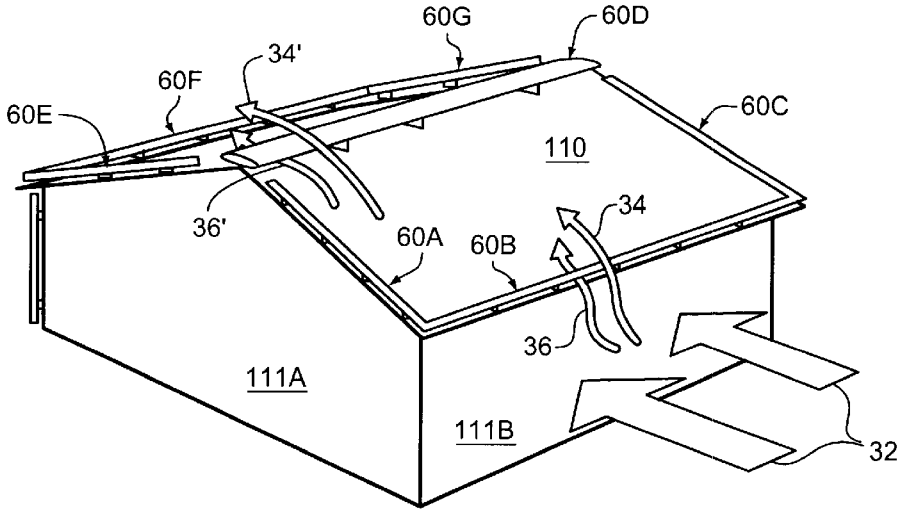
FIG. 6 illustrates alternative mounting positions for a structure of the invention. Although shown to extend along each edge-length and each corner of rooftop 110, according to the invention, shorter edge-lengths/sections of the elongated structures may be used 'locally'—for example, along a corner in an open-V (for reference, FIG. 11B).
Figure 7A:
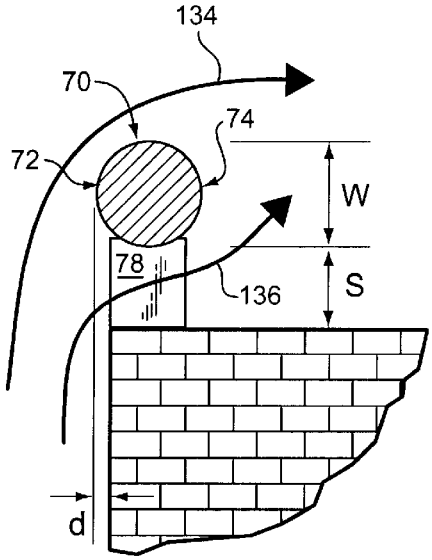
Figure 7B:
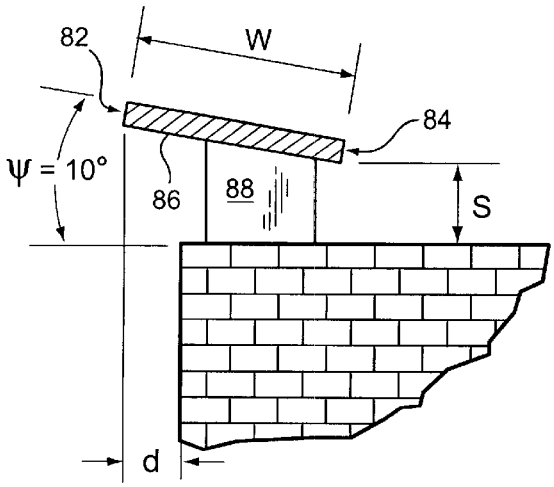

One can readily appreciate the flexibility of the invention in connection with FIG. 6 illustrating alternative mounting positions for a structure of the invention. Although sections 60A–60G are shown to extend nearly the full length of each edge-length of rooftop 110, according to the invention, shorter edge-lengths/sections of the elongated structures may be used locally—for example: shorter sections of elongate member can be mounted to extend partway along an edge-length, or an apparatus with an open-V shape (see also FIG. 11B at 20A and 20B) can be mounted along a corner to protect equipment and other structures projecting away from the roof, such as the structures labeled 222 in FIGS. 11A–11B. As labeled in FIG. 6: elongated member section 60B operates to redirect wind thereunder along directional arrow 36, whereas elongated member section 60D operates to redirect wind thereunder along directional arrow 36'.

One can readily appreciate the flexibility of the invention in connection with FIGS. 7A–7F depicting alternative structural configurations for an apparatus of the invention atop a side plan view of the building rooftop. Elongated members are respectively labeled 70, 80, 280, 90, 100, 140 in FIGS. 7A–7F, as are leading edge portions 72, 82, 282, 92, 102, 142, and trailing ends 74, 84, 284, 94, 104, 144. Further, in FIG. 7A for reference, directional arrows are labeled 134, 136 of flow as separated by member 40. In each case, a vertical support strut is illustrated and respectively labeled 78, 88, in FIGS. 7A and 7B and shown but not labeled for simplicity in the remaining FIGS. 7C–7F. These struts operate to anchor the respective structure to a roof, wall, frame, or grounded support member; and although not illustrated, one can appreciate that the support may be anchored to any of these.

FIGS. 8A and 8B illustrate the direction of oncoming flow as it begins to form a re-circulation region over the rooftop, after butting up against the steep embankment wall, for the case where there is no device, see FIG. 8A, and in the case as has been tried before, with a simple rectangular solid parapet atop a roof, see FIG. 8B: Oncoming flow re-circulates to create vortices with strong, structural-damaging suction underneath; for further reference see FIGS. 1A–1B and 2B—2B.

Figure 9:
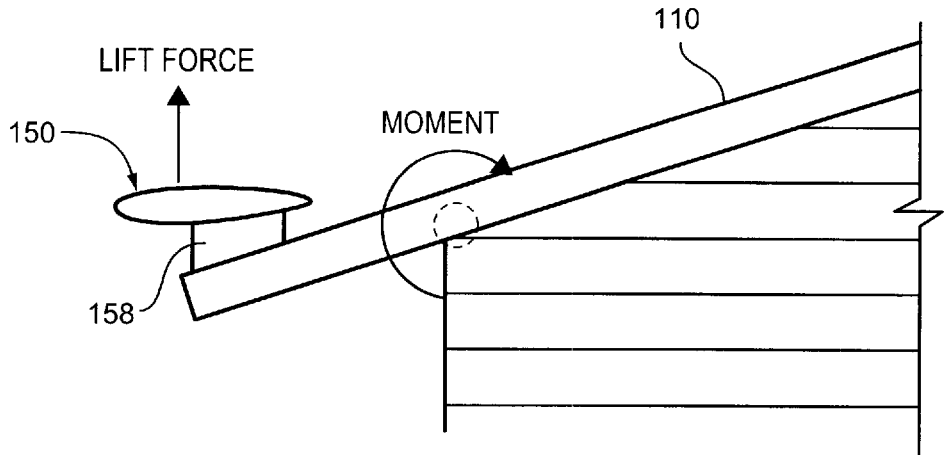
FIGS. 9 and 10 are schematic sectional illustrations that depict additional novel structures of the invention affixed atop a slightly inclined roof.
Figure 10:
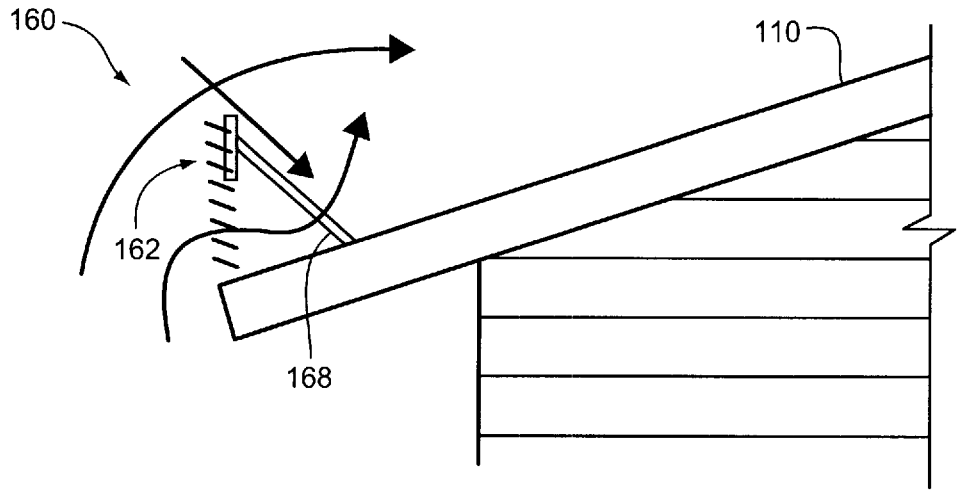

FIGS. 9 and 10 are schematic sectional illustrations that depict additional novel structures of the invention affixed atop a slightly inclined roof. In each of these cases, the roof edge extends out over the building sidewall. In FIG. 9, member 150 has a cross-section the shape of a thin oval having a leading edge portion with a curvilinear surface and is oriented at an incline with respect to rooftop 110 as supported by support 158. FIG. 10 illustrates a further embodiment of the invention at 160 having a fence-type elongated member and associated support 168 mounted to inclined rooftop 110. The leading edge portion generally shown at 162 preferably extends, as positioned, into the TR such that flow is caught and separated as depicted here.

Figure 11A:
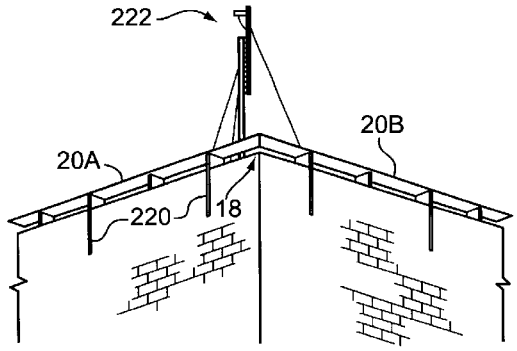
FIGS. 11A–11C are isometric depictions of a V-shaped apparatus of the invention atop a building structure having a rooftop 10.
Figure 11B:
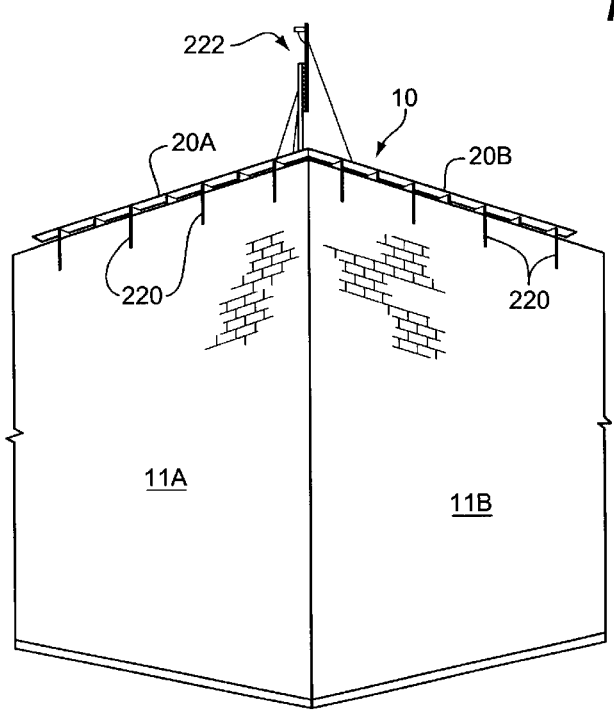
Figure 11C:
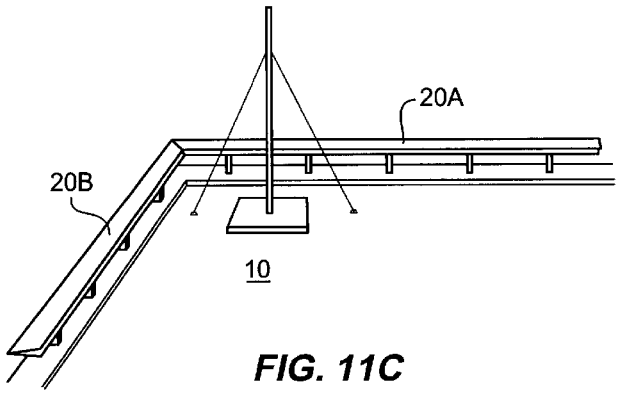

As referenced several times already, FIGS. 11A–11C are isometric depictions of a V-shaped apparatus of the invention atop a building structure having a rooftop 10; FIG. 11C is a view looking toward the V-shape as taken from on top of rooftop 10. Further noticeable in FIGS. 11A–11B and identified at 220, are reinforcement strips, made out of for example metal, for mounting to both one or more supports and a respective sidewall labeled 11A, 11B, by bolts, screws, material compatible adhesive or other suitable fastening/securing means.

Figure 12A:
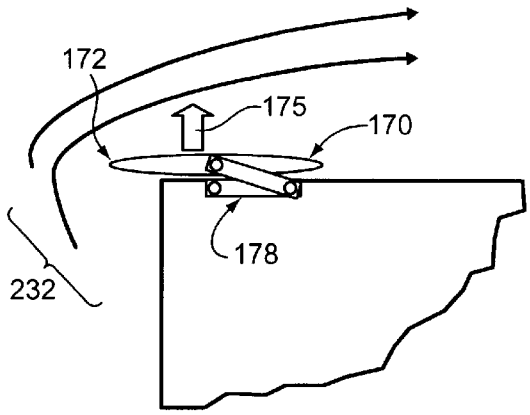
FIGS. 12A–12D are side plan views in schematic-style, detailing vertical supports further comprising the self-deployments mechanism of the invention.
Figure 12B:
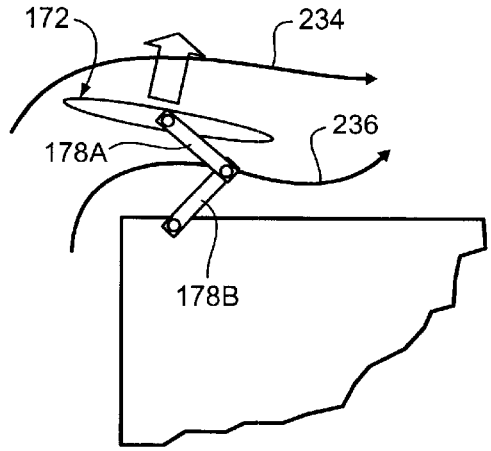
Figure 12C:
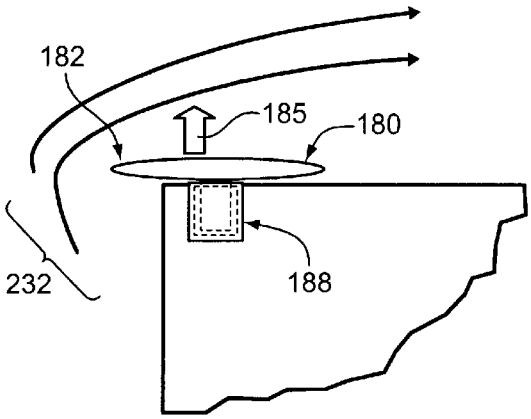
Figure 12D:
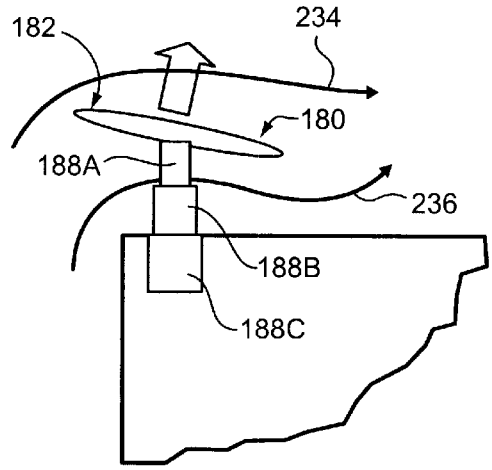

FIGS. 12A–12D are side plan views in schematic-style, detailing vertical supports further comprising the self-deployment mechanism of the invention: FIGS. 12A and 12C illustrate a lowered position of the elongated member and FIGS. 12B and 12D illustrate the affect of a sufficiently-strong gust to create enough lift in the direction of arrows labeled, respectively, 175 and 185 to move the elongated member into position for operation. Once in operational position, respective leading edge portion 172, 182 catches a portion of oncoming flow 232 to redirect it: 236, 234. Each support 178, 188 may include a self-deployment mechanism as illustrated, to operate with respective elongated members 170, 180. For certain configurations, the lowered position may comprise at least a portion of the lower flow-surface in contact with the rooftop, and includes sections/extensions such that the elongated member is adapted for moving into its second position, see FIGS. 12B and 12D. In FIGS. 12A–12B the self-deployment mechanism includes a first and second hinged extension 178A, 178B. The support upper-end is pivotally secured to the lower flow-surface of member 170 and the support lower-end is pivotally secured to extend from the rooftop. These hinged extensions when in the lowered position are in a generally folded arrangement, see FIG. 12A, and are adapted for locking into place upon reaching the second position, see FIG. 12B. Alternatively as depicted in FIGS. 12C–12D, the mechanism may comprise a plurality of telescoping sections 188A–188C located, while in the first lowered position, substantially below the rooftop's surface, see FIG. 12C, and adapted for locking into place upon reaching the second position, see FIG. 12D.

Due to the loads structures may experience atop a roof during high-winds, it is critical that the apparatus structures of the invention be adequately anchored to the roof or frame structure. Permanent affixation or mounting—to the extent a 'permanent' mode is possible, given inclement weather and expected harsh and routine outdoor conditions—of the structures to a rooftop, wall, ground support, and so on, can be accomplished by employing a suitable mechanism selected from a wide range of those available, as well as specifically-tailored designs, including bolts, screws, wiring, fastening plates, weather resistant adhesive, with or without press fit engagement, partially or fully embedding or otherwise integrating a support member of the structure within the roof, wall, or ground extension by molding, forming, setting, press-fitting, and so on; or any combination of the above. Further, placement of sections of the elongated structures of the invention can be done to address 'local' pressure drops at a roof corner, or along any side of the roof to at least 'locally' eliminate the amplification of pressure drops—as modeled, here, to occur within the region of the vortices—caused by wind gusts to reduce the risk of damaging fixtures secured to the roof, such as air conditioner compressors, fan/vent assembly, radio or TV antenna, solar panels, signage, smokestack, and so on. For further reference, in connection with the theoretical framework for flow characterization of incident wind, see Attachment A, Banks, D. (spring 2000), and Attachment B, Wu, F., excerpts from dissertation, Chapter 8—both of which are identified above and are incorporated herein be reference.

While certain representative embodiments and details have been shown merely for the purpose of illustrating the invention, those skilled in the art will readily appreciate that various modifications may be made without departing from the novel teachings or scope of this invention. Accordingly, all such modifications are intended to be included within the scope of this invention as defined in any claim following this description. Although the commonly employed preamble phrase "comprising the steps of" may be used herein, or hereafter, in a method claim, the Applicants in no way intend to invoke 35 U.S.C. Section 112 ¶6. Furthermore, in any claim that is filed hereafter, any means-plus-function clauses used, or later found to be present, are intended to cover the structures described herein as performing the recited function and not only structural equivalents but also equivalent structures.

What is claimed is:

1. An apparatus secured to extend upwardly from a rooftop for redirecting free oncoming flow of a gas passing over an edge of the rooftop, the apparatus comprising:

an elongated member having upper and lower flow-surfaces, and a leading edge portion having a leading-rim extending therealong;

a plurality of supports, each having upper- and lower-ends, said upper-end of each support securely extending from said lower flow-surface such that a spacing exists between each said support, said lower-end of each support in contact with the rooftop, said lower flow-surface and the rooftop in spaced relationship; and said elongated member positioned with said leading-rim protruding out over the edge of the rooftop a horizontal distance and adapted to extend into the oncoming flow, and a vertical spacing is provided between the rooftop and the lower flow-surface for the redirecting of at least a portion of the oncoming flow under said leading edge portion and along said lower flow-surface.

2. The apparatus of claim 1 wherein said lower-end of each support is mounted to the rooftop; the rooftop is inclined at less than a 40% grade; and said lower flow-surface is oriented in a decline with said leading edge portion being located a vertical distance further from the rooftop than that of a trailing end portion of said elongated member such that the redirecting comprises said at least a portion of the oncoming flow passing along said lower flow-surface and in a direction toward the rooftop.

3. The apparatus of claim 1 wherein: the free oncoming flow of a gas comprises a strong gust of wind with a transition flow region, over the rooftop the oncoming flow is generally bounded below by a re-circulation region wherein flow of said wind travels in a circuitous motion; a cross-section of said elongated member taken between said leading edge portion and a trailing end portion of said elongated member is a shape selected from the group consisting of: an oval, a thin-irregular oval, an airfoil, a triangle, a rectangle, a thin-irregular rectangle, a circle, a thin-plate having a curvilinear leading edge portion, a thin-irregular wave-shape, a polygon, and a thin-irregular polygon; and the redirecting comprises said at least a portion of the wind passing along said lower flow-surface and into said re-circulation region.

4. The apparatus of claim 1 wherein: said leading-rim comprises a curvilinear surface, said lower flow-surface is generally planar, and a horizontal distance, d, of said leading-rim from a sidewall of a building to which the rooftop is attached, is between 0.05% and 75% of, a width, w, of said elongated member as measured from said leading-rim to a trailing end thereof.

5. The apparatus of claim 1 wherein: said leading edge portion comprises a curvilinear surface, said lower flow-surface is generally planar, and said horizontal distance is a distance, d, of said leading-rim from a sidewall of a building to which the rooftop is attached, said distance, d, being less than a vertical distance, s, between the rooftop and a closest point of said lower flow-surface to the rooftop.

6. The apparatus of claim 1 further comprising a second elongated member joined at an end of the first elongated member in angled positional relationship; and wherein: the edge of the rooftop comprises a corner interposed between a first and second edge-length in said angled positional relationship, and at least two of said supports is mounted to the rooftop along said first edge-length and at least two of said supports is mounted to the rooftop along said second edge-length.

7. The apparatus of claim 6 wherein:

said leading edge portion comprises an angled surface;

said lower flow-surface is generally planar and is a declining orientation;

the redirecting comprises said at least a portion of the oncoming flow passing along said lower flow-surface and in a direction toward the rooftop; and at least one of said supports is reinforced by a plurality of metal strips fastened to a respective sidewall of a building to which the rooftop is attached.

8. The apparatus of claim 1 wherein:

the free oncoming flow of a gas comprises a strong gust of wind, each of said supports comprises a self-deployment mechanism; and said elongated member having a first lowered position and is adapted for moving into a second position in said spaced relationship; whereby, while in said first position, when one of said gusts of wind is sufficiently-strong against said elongated member, said elongated member moves to said second position.

9. The apparatus of claim 8 wherein said self-deployment mechanism comprises a first and second hinged extension, each said support upper-end pivotally secured to said lower flow-surface and each said support lower-end pivotally secured to extend from the rooftop; said hinged extensions, in said first lowered position, in a generally folded arrangement and adapted for locking into place upon reaching said second position, and in said second position, said elongated member is oriented in a decline.

10. The apparatus of claim 8 wherein: said self-deployment mechanism comprises a plurality of telescoping sections located, in said first position, substantially below the rooftop's surface, said sections adapted for locking into place upon reaching said second position; and said leading edge portion comprises a curvilinear surface.

11. An apparatus secured to extend upwardly from a rooftop for redirecting free oncoming flow of a gas passing over an edge of the rooftop, the apparatus comprising:

an elongated member having a lower flow-surface and a leading edge portion having a leading-rim extending therealong;

a plurality of supports, each having upper- and lower-ends, said upper-end of each support extending from said lower flow-surface such that a spacing exists between each said support, said lower-end of each support in contact with the rooftop; and said elongated member positioned with said leading-rim extending outwardly from the edge of the rooftop and adapted to extend into the oncoming flow, and said elongated member so positioned to provide a vertical spacing between the rooftop and the lower flow-surface for the redirecting of at least a portion of the oncoming flow under said leading edge portion and along said lower flow-surface.

12. The apparatus of claim 11 wherein:

the free oncoming flow of a gas comprises gust of wind with a transition flow region, said leading-rim protruding out over the edge and extending into said transition flow region; and and a horizontal distance, d, of said leading-rim from a sidewall of a building to which the rooftop is attached, is between 0.05% and 75% of, a width, w, of said elongated member as measured from said leading-rim to a trailing end thereof.

13. The apparatus of claim 11 wherein: said leading edge portion comprises an angled surface; and said lower flow-surface is generally planar and is oriented in a decline with said leading edge portion being located a vertical distance further from the rooftop than that of a trailing end portion of said elongated member such that the redirecting comprises said at least a portion of the oncoming flow passing along said lower flow-surface and in a direction toward the rooftop.

14. The apparatus of claim 11 wherein a cross-section of said elongated member taken between said leading edge portion and a trailing end portion of said elongated member is a shape selected from the group consisting of: an oval, a thin-irregular oval, an airfoil, a triangle, a rectangle, a thin-irregular rectangle, a circle, a thin-plate having a curvilinear leading edge portion, a thin-irregular wave-shape, a polygon, and a thin-irregular polygon.

15. The apparatus of claim 14 wherein: each said support lower-end is permanently affixed to a substantially rigid elongated horizontal structure, said horizontal structure is mounted to the rooftop's surface; each said support upper-end is fabricated as an integral part of said lower flow-surface.

16. The apparatus of claim 11 further comprising a second elongated member permanently joined at an end of the first elongated member in angled positional relationship; and wherein: the edge of the rooftop comprises a corner interposed between a first and second edge-length in said angled positional relationship, and at least two of said supports is mounted to the rooftop along said first edge-length and at least two of said supports is mounted to the rooftop along said second edge-length.

* * * * *

UNITED STATES PATENT AND TRADEMARK OFFICE

CERTIFICATE OF CORRECTION

PATENT NO. : 6,601,348 B2
DATED : August 5, 2003
INVENTOR(S) : Banks et al.

It is certified that error appears in the above-identified patent and that said Letters Patent is hereby corrected as shown below:

Title page,
Item [73] should read:
-- Assignee: Colorado State University Research Foundation,
Fort Collins, CO (US) --

Signed and Sealed this

Sixteenth Day of September, 2003

JAMES E. ROGAN
*Director of the United States Patent and Trademark Office*